United States Patent [19]

Shupe et al.

[11] Patent Number: 4,574,434

[45] Date of Patent: Mar. 11, 1986

[54] BANDING SYSTEM AND COMPONENTS THEREOF

[75] Inventors: James T. Shupe; T. Wayne March, both of Chattanooga, Tenn.

[73] Assignee: Shupe & March Manufacturing, Inc., Chattanooga, Tenn.

[21] Appl. No.: 642,287

[22] Filed: Aug. 20, 1984

[51] Int. Cl.[4] ..... B65D 63/00

[52] U.S. Cl. ..... 24/16 PB; 24/17 AP; 24/19; 24/20 TT; 24/30.5 P

[58] Field of Search ..... 24/16 PB, 16 R, 17 AP, 24/19, 20 TT, 30.5 P

[56] References Cited

U.S. PATENT DOCUMENTS

| | | | |
|---|---|---|---|
| 2,692,413 | 10/1954 | Flora | 24/16 |
| 3,107,935 | 10/1963 | Erke | 24/16 PB |
| 3,192,584 | 7/1965 | Pape | 24/16 PB |
| 3,300,825 | 1/1967 | Andreasen | 24/16 PB |
| 3,606,648 | 9/1971 | Schuler | 24/16 PB |
| 3,653,099 | 4/1972 | Hoffman | 24/16 PB |
| 3,654,669 | 4/1972 | Fulton | 24/16 PB |
| 3,721,750 | 3/1973 | Countryman | 24/16 PB |
| 3,744,096 | 7/1973 | Kok | 24/16 |
| 3,747,164 | 7/1973 | Fortsch | 24/16 PB |
| 3,816,878 | 6/1974 | Fulton et al. | 24/16 |
| 3,900,923 | 8/1975 | Thomas | 24/16 |
| 3,909,884 | 10/1975 | Weckesser | 24/73 |
| 4,064,601 | 12/1977 | Miyagishima | 24/16 |
| 4,138,770 | 2/1979 | Barrette et al. | 24/16 |
| 4,283,816 | 8/1981 | Tanaka | 24/269 |
| 4,306,740 | 12/1981 | Kleykamp et al. | 24/20 TT |
| 4,356,599 | 11/1982 | Larson et al. | 24/16 PB |
| 4,377,887 | 3/1983 | Valestin | 24/16 PB |

FOREIGN PATENT DOCUMENTS

| | | | |
|---|---|---|---|
| 2360992 | 7/1974 | Fed. Rep. of Germany | 24/16 PB |
| 1123839 | 9/1956 | France | 24/16 PB |
| 2063354 | 6/1981 | United Kingdom | 24/16 PB |

OTHER PUBLICATIONS

Brady Catalog—p. 19 (device mentioned on p. 2 of the present application).

*Primary Examiner*—Victor N. Sakran

*Attorney, Agent, or Firm*—Beveridge, DeGrandi and Weilacher

[57] ABSTRACT

A banding clip has two oppositely facing band engaging mechanisms for receiving the opposite ends of a looped band. The band has a lower base portion which has transversely extending teeth of rectangular cross section on its upper surface. The clip is open sided to permit the release of the band engaging mechanism. A hinge is located between the band engaging mechanisms so the clip may conform somewhat to the shape of a banded object. A tightening tool is engageable against an external tool face located on the clip between the oppositely facing band engaging mechanisms, and a band outlet is formed in this tool face at a position which is higher than and spaced from the opposite band engaging mechanisms.

20 Claims, 6 Drawing Figures

BANDING SYSTEM AND COMPONENTS THEREOF

BACKGROUND OF THE INVENTION

This invention relates to a banding system and to the clip and band which are used in connection with the banding system.

Banding systems are widely used in many industries for a variety of purposes. For example, they are used for baling and palletizing materials in the agricultural and packaging fields. The are also used for banding together electrical conductors and to clamp flexible duct to the metal collars of takeoffs and boots in heating, ventiliating and air conditioning systems.

In the heating, ventilating and air conditioning industry, hereinafter referred to as the HVAC industry, flexible duct has largely replaced round metal pipe and fiberglass wrap in air distribution systems. Metal takeoffs are installed in the extended plenum or square trunk duct, and flexible duct is run from the trunk to the boots on the registers, grills or difusers. The flexible duct is telescopically placed over the metal collars of the takeoffs and boots and circumferential clamps are applied to the ducts in position. A "clamp" in this respect is an integral body of injection molded plastic provided with a self-locking head at one end of a band. The band is positioned circurferentially around the duct, inserted through the locking head, and drawn tightly by a tensioning tool. When using such clamps, there is an unavoidable waste of band material unless, as is seldom the case, the contractor is able to maintain an inventory of clamps which have a wide variety of band lengths. For small diameter ducts, a substantial amount of the band material is cut from the clamp and wasted, while with larger ducts it is sometimes necessary to fasten two or more of the clamps together to achieve the circumference of the duct. The present invention utilizes a band of indeterminate length, i.e. a band which can be cut approximately to the required length without excessive wasting. The band can be tightened by an inexpensive tool, and the contractor is not required to maintain an inventory of devices of different band lengths.

Although not used significantly in the HVAC industry, there have been a number of banding systems which utilize indeterminate length band. Perhaps the best know of these are the strapping systems which use hand tightened buckles of metal or plastic, or those which have tightening tools and apply either metal clips or form a heat seal between the opposite end portions of the band. The hand tightened devices are not practical for HVAC purposes because sufficient tension cannot be applied to the circumferential band. As to the systems which use heat seal principles or metal clips in connection with the tightening tool, it has been found that the tools are too expensive to justify their usage in lieu of the clamping systems described in the previous paragraph. Self-locking buckles or clips for indeterminant length band were sold a number of years ago by Weckesser Company, Inc., Chicago, Ill., and are presently being sold by W. H. Brady Company, Milwaukee, Wisc. A bidirectional clip with toothed locking tangs is the subject of Valestin U.S. Pat. No. 4,377,887. However, the present invention presents a number of advantages which are not realized by the Weckesser and Valestin systems. One disadvantage of the Weckesser and Valestin systems is that they include bands which are provided with perforations which inherently weaken the band and are incapable of being spaced closely to each other in order to provide the relatively fine increments of adjustment achieved by the present invention. Other advantages of the present invention over Weckesser and Valestin are described elsewhere in this specification.

An important object of the invention is to provide a bidirectional one piece locking clip which can be manufactured inexpensively and can be used in connection with inexpensive indeterminant length band material. Another object is to provide an improved band which has a novel configuration and is preferably formed of fiberglass reinforced plastic which is extruded and embossed. Another object is to provide a clip for a banding system wherein the clip may conveniently be disengaged to release the band when desired. A further object is to provide a clip of the type described with a structure which permits an end of the band to protrude from the clip for tightening purposes without being obstructed by the clip and components which engage the opposite end of the band. Still another object is to provide a clip for a banding system in which a tool face is conveniently positioned between the two band engaging means for convenience of manufacture and usage. Still another object is to provide a banding system of the type described wherein the clip has a hinge formed therein so that the clip will conform to the shape of a duct or other object encircled by the looped band. Other objects and advantages will be recognizable by those skilled in the art from a study of the following drawings and descriptions.

SUMMARY OF THE INVENTION

This invention relates to a clip for a banding system in which the clip holds a loop formed of any selected length of band around a flexible ductwork, electrical cables or other objects. The invention also relates to a novel band configuration and a banding system wherein a looped band has its opposite ends connected together by a clip. More specifically, the invention relates to improvements to a banding system clip which has a body provided with first and second band engaging means which are each capable of receiving a band portion which is inserted longitudinally therein in one direction and being operable to engage the band portion and prevent its withdrawal from the body in an opposite direction. At least one of the band engaging means has a band receiving gap with opposed surfaces for engaging opposed faces of a band inserted in the clip. One of the surfaces has tooth means for engaging teeth in a band. Resilient means are provided for biasing one of the surfaces toward the other surface when a band is in the gap so that the tooth means will securely engage with the teeth in a band.

Several improvements have been made to the clips of the type described in the preceding paragraph. The first such improvement is that the clip body has an open side providing lateral access to the gap so that the gap may be forcibly enlarged to disengage the tooth means of the band engaging means from the teeth in a band. The gap has a uniform longitudinal cross section across the entire width of the body to simplify manufacture of the device by extrusion or injection molding processes. Another improvement is that the clip is arranged so that the opposite ends of the band do not obstruct or interfere with each other. In this regard, the clip has an outlet leading from the first band engaging means to enable an end of the band to protrude from the clip for engagement by a tightening means, and this outlet is spaced from and higher than the second band engaging means so that the protruding end of the band is not obstructed by the second band engaging means. In association with this improvement, the gaps of the band engaging means preferably lie at an obtuse angle relative to each other.

A further improvement relates to the location of a tool face which is provided on the clip for engagement by a tightening tool. This tool face is located at the outlet of one of the band engaging means, and this location is between the first band engaging means and the second band engaging means.

In another respect, the invention represents an improvement in that the clip is constructed to conform somewhat to the shape of an object encircled by the looped band. This feature is realized by providing the clip with a hinge formed therein between the first band engaging means and the second band engaging means.

All of the improvements described above are also applicable to a banding system wherein such an improved clip is utilized together with a toothed band formed in a loop. A first band portion at one end of the loop 1ies in the gap of and is engaged by the first band engaging means, and a second band portion at the other end of the loop is engaged by the second band engaging means.

The band itself includes a lower base portion and a plurality of teeth which are located on the upper surface of the base portion to extend transversely across the band. The band configuration is non-directional in the respect that its longitudinal cross sections are the same when viewed in opposite lateral directions. Preferably, the teeth of the band are rectangular in a longitudinal cross section of the band.

For a more complete understanding of the invention, reference is made to the accompanying drawings and the following detailed description which disclose a preferred embodiment of the invention.

DETAILED DESCRIPTION

Figure 1:
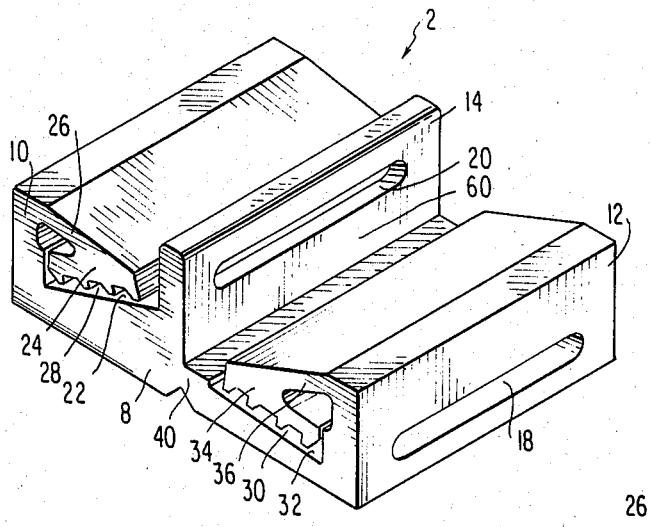
FIG. 1 is a perspective view of a banding clip constructed according to the invention.

A banding system constructed according to the invention includes a clip and a band which is formed in a loop and has its opposite ends connected to the clip. The clip 2 is shown in FIG. 1. It is a unitary piece of plastic material which is molded, extruded, and/or machined. It may be formed of a nylon composition of the type widely available on a commercial basis under the trademark ZYTEL.

Figure 4:
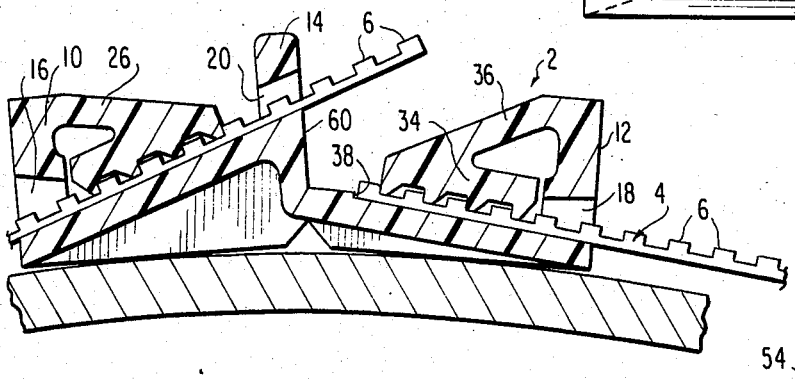
FIG. 4 is a sectional view of a banding system which utilizes the clip of FIGS. 1-3 and a band which is looped around a conduit or duct.
Figure 5:
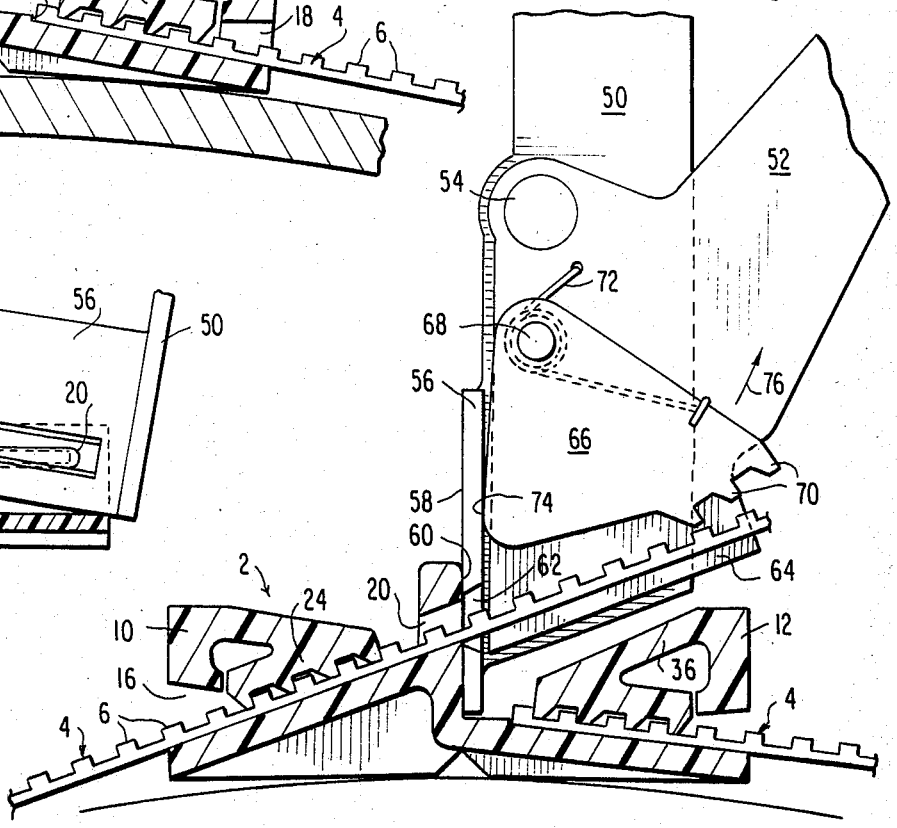
FIG. 5 is a sectional view showing a tightening tool associated with the clip, wherein the tightening tool has a pressure surface bearing against the tool face of the clip.

The band 4, shown best in FIGS. 4 and 5, is preferably made of plastic which is reinforced by glass fibers. Such a band may be manufactured in a known manner by extrusion, and then passed between a cold lower roller and a heated upper roller which heats and embosses the upper surface of the band to provide it with the teeth 6 as shown. The formed band thus has a continuous lower base portion with a lower surface which is smooth and an upper surface which has a plurality of teeth 6 disposed transversely thereon. The teeth are preferably of rectangular cross section; and, the band is nondirectional in the respect that its longitudinal cross sections are the same when viewed in opposite lateral directions. This is in contrast to the inclined sawtooth-like teeth used in some bands.

The clip 2 includes a base 8 which extends the full length of the clip, end walls 10 and 12 which extend upwardly from opposite ends of the base, and a center wall 14 which extends upwardly from a midportion of the base 8. Openings 16 and 18 are formed in the end walls to receive the opposite ends of a band. An opening 20 is formed in the center wall 14 to permit one end of the band to project from the clip for engagement by a tightening tool.

The leftward portion of the base 8 has an upper band supporting surface 22 which is inclined inwardly and upwardly from opening 16 to opening 20. A toothed pawl 24 faces this surface 22, and this pawl 24 is resiliently connected to the end wall 12 by a resilient section 26. As will be evident from FIG. 2, there is a band receiving gap 28 located between the surface 22 and the pawl 24. The lower surface of the pawl 24 and the upper surface 22 of the base engage the opposite faces of the inserted band 4 as will be seen in FIG. 4. The thickness of the gap 28 and the resilience of section 26 are such that, when a band is inserted in the gap 28, the teeth on the lower surface of the pawl 24 will securely engage the teeth 6 in the band 4. The pawl teeth are inclined and they have a ratcheting relationship with respect to the rectangular teeth of the band so that when the left end of the band is inserted longitudinally through the opening 16 and gap 28 in a rightward direction, the teeth on the pawl 24 will prevent withdrawal of the band in the opposite or leftward direction.

The band engaging means on the right side of the clip operates similarly to the left side components described in the preceding paragraph. However, it operates in an opposite direction, it has a lower position and lesser inclination, and it leads to an abutment or stop rather than to a band outlet opening. The right end of the band 4 is inserted into the opening 18 and enters the gap 30 formed between the upper surface 32 of the base 8 and the toothed lower surface of a pawl 34. The pawl 34, being supported on end wall 12 by a resilient section 36, permits movement of the band through the gap 30. The teeth on the pawl 34 engage the band to prevent its withdrawal in a reverse or rightward direction. The final position of the band is reached when the end of the band comes into contact with a stop shoulder 38 formed in the base.

As shown in FIG. 4, the lower surface of the clip is able to conform somewhat to the curvature of a flexible duct or other object which is encircled by the looped band. This conformance is made possible by the presence of a resilient hinge section 40 in the base of the clip. This hinge section is located adjacent to the V-shaped notch which is formed in the base of the clip, between the left and right band engaging means.

Figure 2:
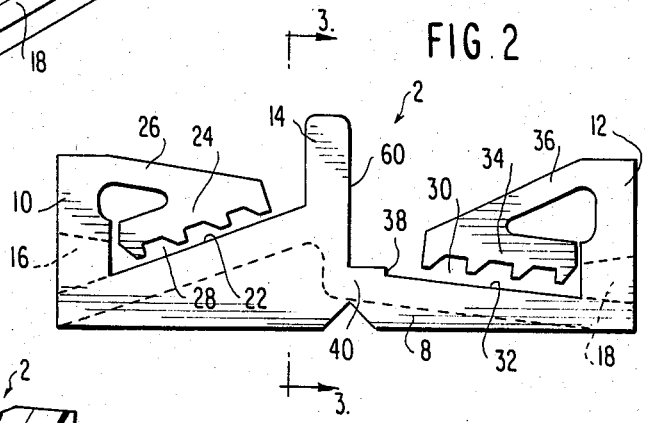
FIG. 2 is a side elevational view of the banding clip of FIG. 1.

An advantageous feature of the invention, best shown in FIGS. 1 and 2, is that the side of the clip 2 is open. This provides lateral access to the band-receiving gaps 28 and 30 so that the band may be released from the clip by disengaging the teeth of the pawls 24 and 34 from the teeth 6 of the band 4. This is accomplished simply by inserting a screwdriver or other tool into the gap to forcibly enlarge it. When both sides are open as shown, there are advantages from a manufacturing standpoint as this simplifies the dies for injection molding, and it makes it possible to form the clip by machining the teeth and openings in an extruded piece which is cut to any desired width.

When the banding system is used to suspend banded objects, for example to hang electrical conductors from a messenger wire, the center wall 14 may be provided with a small circular opening for receiving a suspension member such as a cord or wire.

Figure 3:
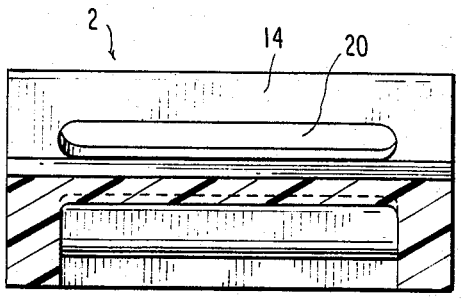
FIG. 3 is a sectional view of the banding clip of FIG. 1, as seen along the section line 3—3 in FIG. 2.

Referring to FIGS. 3 and 4, it will be seen that the band supporting surfaces 22 and 32 on the base 8 lie at an obtuse angle relative to each other, and these surfaces 22 and 32 are oppositely inclined in upward and inward directions. Surface 22 is higher than surface 32, and the outlet from gap 28, preferably defined by the opening 20, causes the left end of the band 4 to protrude from the clip for engagement by a tightening means which may be manual or mechanical. The band outlet is spaced from and is higher than the band engaging components 32 and 34 at the right side of the clip so that the protruding end of the band 4 is not obstructed by these right side components.

The use of a mechanical tightening tool is preferred, and a suitable tool for this purpose is shown in FIG. 5. It has two members 50 and 52 which are pivotally interconnected at 54 so that each member 50 and 52 has an upper handle portion and a lower working portion. The working portion of member 50 has a transverse vertical flange 56 provided with a pressure surface 58 which lies against an exposed tool face 60 on the center wall 14 of the clip. An open ended slot 62 in flange 56 aligns with the clip outlet opening 20. The other member 52 of the tool has a flange 64 which supports the lower surface of the band 4. Member 52 also carries a pivoted band engaging pawl 66 which is connected to the member 52 at 68. This pawl has teeth 70 for engaging the band, and a spring 72 for biasing the pawl in a clockwise direction. When in the position shown in FIG. 5, a shoulder 74 on the pawl 66 engages the flange 56 to overcome the biasing force of the spring 72 and to raise the teeth 70 from the band.

Figure 6:
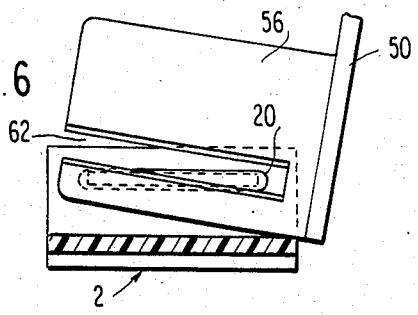
FIG. 6 is a diagrammatic view showing the step of shearing the protruding end of the band with the tightening tool.

In use, the member 50 of the tool is stationary with respect to the clip 2, and the member 52 moves in the direction shown by the arrow 76. Such movement permits the teeth 70 to engage the band 4 and move it to the right, exerting tension on the band and drawing it further through the gap 28 between the surface 22 and the pawl 24. After the band is given the desired amount of tension, the tool is tilted as shown in FIG. 6 until the edges of the tool slot 62, in coaction with the edges of the outlet opening 20 on the clip, shear the band in the plane of the tool face 60.

Persons familiar with the field of the invention will realize that it may be practiced by a number of devices which differ in appearance and form from the disclosed embodiment. Therefore, it is emphasized that the invention is not limited to the disclosed embodiment but is embracing of a variety of structures which fall within the spirit of the following claims.

We claim:

1. A clip for a banding system in which the clip holds a loop formed of any selected length of band around flexible ductwork, electrical cables or other objects, said clip comprising:

a body having first band engaging means and second band engaging means, said first band engaging means being capable of receiving a first band portion which is inserted longitudinally therein in one direction, and being operable to engage the first band portion and prevent its withdrawal from the body in an opposite direction, said second band engaging means being capable of receiving a second band portion which is inserted longitudinally therein in one direction, and being operable to engage the second band portion and prevent its withdrawal from the body in an opposite direction, at least one of said band engaging means having a band-receiving gap with opposed surfaces for engaging opposed faces of a band inserted in the gap, at least one of said surfaces having tooth means formed therein for engaging teeth in a band, means for providing a resilient biasing force which is operable to engage said tooth means of the clip with the teeth of a band inserted in the gap, said body having an open side for simplifying the configuration of dies used for injection molding of the clip, said open side providing access to said gap in a direction which is lateral to a band inserted in the gap to permit forcible enlargement of the gap and convenient disengagement of the clip to release the band when desired.

2. A clip according to claim 1 wherein said clip has an outlet leading from the first band engaging means to enable an end of the band to protrude from the clip for engagement by a tightening means, said outlet being spaced from and being higher than the second band engaging means so that the protruding end of the band is not obstructed by the second band engaging means.

3. A clip according to claim 2 wherein said gap has a uniform cross section across the entire width of the body, said body having two open sides for convenience of formation of the clip by molding or extrusion.

4. A clip according to claim 1 having an outlet leading from the first band engaging means to enable an end of the band to protrude from the clip for engagement by a tightening tool, said clip having an external tool face which is located at the outlet and is engageable by a tightening tool, said external tool face being located between the first band engaging means and the second band engaging means.

5. A clip according to claim 4 wherein said outlet is spaced from and is higher than the second band engaging means so that the protruding end of the band is not obstructed by the second band engaging means.

6. A clip according to claim 1 in combination with a band which is provided with teeth and is formed in a loop, said band having a first band portion at one end of the loop lying in the gap of and engaged by the first band engaging means, said band having a second band portion at the other end of the loop engaged by the second band engaging means.

7. A clip according to claim 6 wherein the band configuration is non-directional in the respect that its longitudinal cross sections are the same when viewed in opposite lateral directions.

8. A clip according to claim 7 wherein the teeth of the band are rectangular in said longitudinal cross sections.

9. A clip for a banding system in which the clip holds a loop formed of any selected length of band around flexible ductwork, electrical cables or other objects, said clip comprising:

a body having first band engaging means and second band engaging means, said first band engaging means being capable of receiving a first band portion which is inserted longitudinally therein in one direction, and being operable to engage the first band portion and prevent its withdrawal from the body in an opposite direction, said second band engaging means being capable of receiving a second band portion which is inserted longitudinally therein in one direction, and being operable to engage the second band portion and prevent its withdrawal from the body in an opposite direction, each of said band engaging means having a band-receiving gap with opposed surfaces for engaging opposed faces of a band inserted in the gap, at least one of said surfaces having tooth means formed therein for engaging teeth in a band, means for providing a resilient biasing force which is operable to engage said tooth means of the clip with the teeth of a band inserted in the gap, said clip having an outlet leading from the first band engaging means to enable an end of the band to protrude from the clip for engagement by a tightening means, said outlet being spaced from and being higher than the second band engaging means so that the protruding end of the band is not obstructed by the second band engaging means.

10. A clip according to claim 9 wherein said gaps of the band engaging means lie at an obtuse angle relative to each other.

11. A clip according to claim 9 having an external tool face which is located at the outlet and is engageable by a tightening tool, said external tool face being located between the first band engaging means and the second band engaging means.

12. A clip according to claim 9 in combination with a band which is provided with teeth and is formed in a loop, said band having a first band portion at one end of the loop lying in the gap of and engaged by the first band engaging means, said band having a second band portion at the other end of the loop lying in the gap of and engaged by the second band engaging means.

13. A clip according to claim 12 wherein the band configuration is non-directional in the respect that its longitudinal cross sections are the same when viewed in opposite lateral directions.

14. A clip according to claim 13 wherein the teeth of the band are rectangular in said longitudinal cross sections.

15. A clip for a banding system in which the clip holds a loop formed of any selected length of band around flexible ductwork, electrical cables or other objects, said clip comprising:

a body having first band engaging means and second band engaging means, said first band engaging means being capable of receiving a first band portion which is inserted longitudinally therein in one direction, and being operable to engage the first band portion and prevent its withdrawal from the body in an opposite direction, said second band engaging means being capable of receiving a second band portion which is inserted longitudinally therein in one direction, and being operable to enagage the second band portion and prevent its withdrawal from the body in an opposite direction, at least one of said band engaging means having a band-receiving gap with opposed surfaces for engaging opposed faces of a band inserted in the gap, at least one of said surfaces having tooth means formed therein for engaging teeth in a band, means for providing a resilient biasing force which is operable to engage said tooth means of the clip with the teeth of a band inserted in the gap, said clip having an outlet leading from the first band engaging means to enable an end of the band to protrude from the clip for engagement by a tightening tool, said clip having an external tool face which is located at the outlet and is engageable by a tightening tool, said external tool face being located between the first band engaging means and the second band engaging means.

16. A clip according to claim 15 in combination with a band which is provided with teeth and is formed in a loop, said band having a first band portion at one end of the loop lying in the gap of and engaged by the first band engaging means, said band having a second band portion at the other end of the loop engaged by the second band engaging means.

17. A clip according to claim 16 wherein the band configuration is non-directional in the respect that its longitudinal cross sections are the same when viewed in opposite lateral directions.

18. A clip according to claim 17 wherein the teeth of the band are rectangular in said longitudinal cross sections.

19. A clip for a banding system in which the clip holds a loop formed of any selected length of band around flexible ductwork, electrical cables or other objects, said clip comprising:

a body having first band engaging means and second band engaging means, said first band engaging means being capable of receiving a first band portion which is inserted longitudinally therein in one direction, and being operable to engage the first band portion and prevent its withdrawal from the body in an opposite direction, said second band engaging means being capable of receiving a second band portion which is inserted longitudinally therein in one direction, and being operable to engage the second band portion and prevent its withdrawal from the body in an opposite direction, at least one of said band engaging means having a band-receiving gap with opposed surfaces for engaging opposed faces of a band inserted in the gap, at least one of said surfaces having tooth means formed therein for engaging teeth in a band, means for providing a resilient biasing force which is operable to engage said tooth means of the clip with the teeth of a band inserted in the gap, said clip having a hinge formed therein between the first band engaging means and the second band engaging means said hinge being oriented to permit changes in inclination between the first band engaging means and the second band engaging means so the clip can conform to the shape of an object encircled by the looped band.

20. A clip according to claim an outlet leading from the first band engaging means to enable an end of the band to protrude from the clip for engagement by a tightening tool, said clip having an external tool face which is located at the outlet and is engageable by a tightening tool, said external tool face being located between the first band engaging means and the second band engaging means.

* * * * *